US011353275B2

(12) United States Patent
Underwood et al.

(10) Patent No.: US 11,353,275 B2
(45) Date of Patent: Jun. 7, 2022

(54) LOW FRICTION INSERTS FOR BOLT CARRIER GROUP

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/196,693

(22) Filed: Mar. 9, 2021

(65) Prior Publication Data

US 2021/0285736 A1 Sep. 16, 2021

Related U.S. Application Data

(60) Provisional application No. 62/987,725, filed on Mar. 10, 2020.

(51) Int. Cl.

| | |
|---|---|
| ***F41A 3/66*** | (2006.01) |
| ***F41A 3/12*** | (2006.01) |
| ***F41A 3/16*** | (2006.01) |
| ***F41A 3/26*** | (2006.01) |
| ***F41A 3/64*** | (2006.01) |

(52) U.S. Cl.

CPC ..... *F41A 3/16* (2013.01); *F41A 3/26* (2013.01); *F41A 3/64* (2013.01); *F41A 3/66* (2013.01)

(58) Field of Classification Search

None

See application file for complete search history.

(56) References Cited

U.S. PATENT DOCUMENTS

| | | | | |
|---|---|---|---|---|
| 1,365,355 | A * | 1/1921 | Thompson | F41A 3/64 89/188 |
| 3,636,648 | A * | 1/1972 | Spencer | F41A 3/64 42/16 |
| 7,937,870 | B2 * | 5/2011 | Brown | F41A 3/66 42/16 |
| 8,689,672 | B2 * | 4/2014 | Cassels | F41C 23/06 89/198 |
| 9,354,005 | B1 * | 5/2016 | Russo | F41A 35/00 |
| 9,791,224 | B1 * | 10/2017 | Russo | F41A 3/66 |
| 10,184,736 | B2 * | 1/2019 | Fumia | F41A 3/66 |
| 10,816,287 | B1 * | 10/2020 | Russo | F41A 3/84 |
| 2010/0000139 | A1 * | 1/2010 | Brown | F41G 1/02 42/96 |
| 2020/0292259 | A1 * | 9/2020 | Law | F41A 3/82 |

* cited by examiner

*Primary Examiner* — Derrick R Morgan

(57) ABSTRACT

A bolt carrier group assembly for a firearm includes at least one metallic bolt carrier group component with an outer metallic surface and at least one insert with an outer surface. The outer surface is at least flush with the outer metallic surface, and the at least one insert has a lower coefficient of friction compared to the at least one metallic bolt carrier group component.

26 Claims, 8 Drawing Sheets

LOW FRICTION INSERTS FOR BOLT CARRIER GROUP

CROSS REFERENCE TO RELATED APPLICATION

This application is related to and claims priority benefit from U.S. Provisional Application No. 62/987,725 ("the '725 application"), filed on Mar. 10, 2020 and entitled "LOW FRICTION INSERTS FOR BOLT CARRIER GROUP." The '725 application is hereby incorporated in its entirety by this reference.

FIELD OF THE INVENTION

The field of the invention relates to firearms, particularly one or more inserts for bolts or bolt carrier groups in firearms.

BACKGROUND

Many breech-loading firearms are designed with a moving bolt or bolt carrier group to facilitate loading cartridges into the chamber of the firearm. The bolt or bolt carrier group blocks the rear opening (breech) of the barrel chamber in preparation for firing the weapon. Whether the operating system of the firearm is designed to cycle manually (bolt-action, lever-action, pump-action, etc.), semi-automatic (gas operation, recoil operation, blowback operation), or automatic, the efficiency, speed, and reliability of the firearm depends on the friction created by movement of the bolt or bolt carrier group. Conventional firearms and their bolts or bolt carrier groups include metallic components designed to move/slide across other metallic components.

To maximize efficiency and reduce the forces required to cycle the firearm, it may be desirable to design new low friction inserts that reduce friction between (i) the internal components of the firearm and (ii) the bolt or bolt carrier group.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a bolt carrier group assembly for a firearm comprises: at least one metallic bolt carrier group component comprising an outer metallic surface; and at least one insert comprising an outer surface, wherein: the outer surface is at least flush with the outer metallic surface; and the at least one insert comprises a lower coefficient of friction compared to the at least one metallic bolt carrier group component.

According to certain embodiments of the present invention, a bolt carrier group assembly for a firearm comprises: at least one metallic bolt carrier group component comprising an outer metallic surface; and at least one insert comprising an outer cylindrical surface, wherein the outer surface is at least flush with the outer metallic surface.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1A-8 illustrate components of various semi-automatic or automatic firearms, the features, concepts, and functions described herein are also applicable (with potential necessary alterations for particular applications) to handguns, rifles, carbines, shotguns, bolt-action, lever-action, pump-action, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP; and shotgun calibers such as, for example, 12 gauge, 20 gauge, 28 gauge, .410 gauge, 10 gauge, 16 gauge. The illustrated embodiments in FIGS. 1A-5B focus on a bolt carrier group for a roller delayed system (a type of blowback operation) and the illustrated embodiments in FIGS. 6A-8 focus on a bolt carrier group for a gas operation system such as the AR-15/M16/M4 platform; however, the concepts and features described herein are also applicable (with potential necessary alterations for particular applications) to other firearms.

Figure 1A:
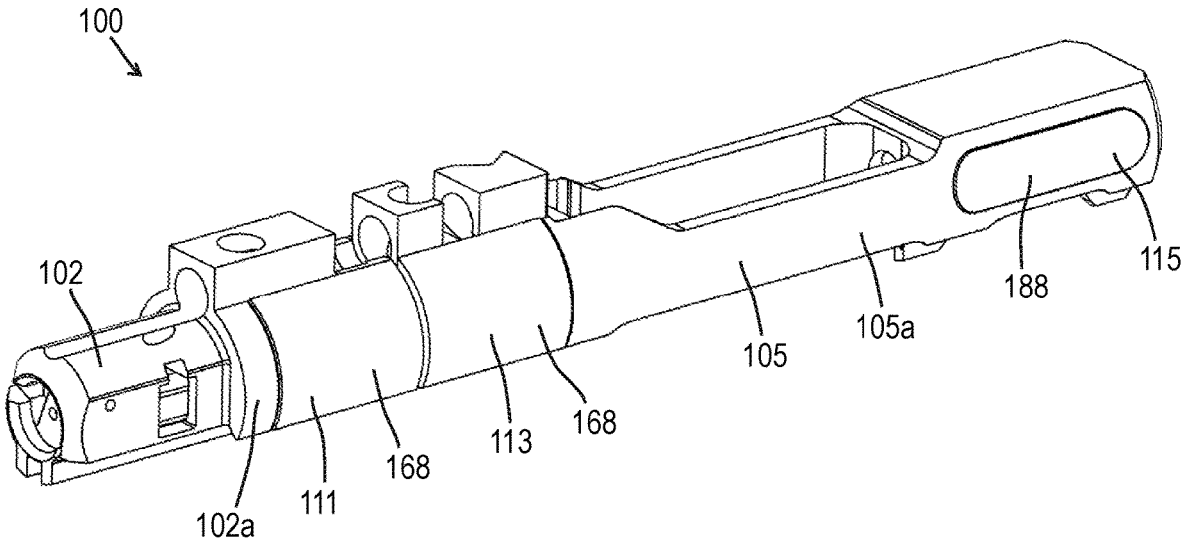
FIGS. 1A and 1B are perspective views of a bolt carrier group according to certain embodiments of the present invention.
Figure 1B:
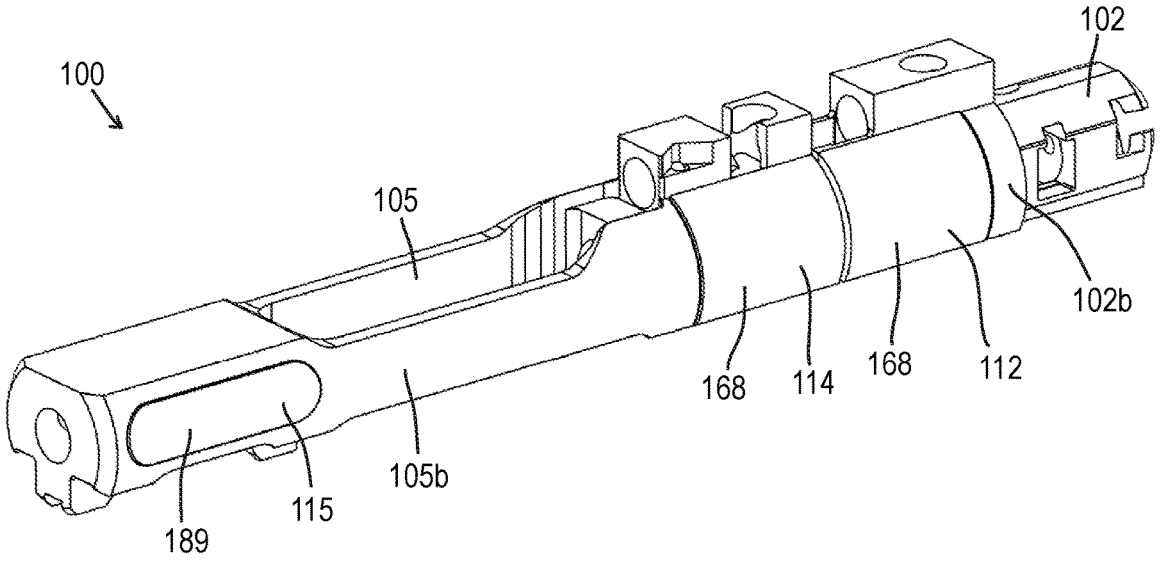

In some cases, a bolt carrier group assembly 100 includes a front bolt 102; a carrier 105 disposed rearward of the front bolt 102; one or more forward inserts 111, 112, 113, 114; and one or more rear inserts 115 (see FIGS. 1A and 1B). Components of the bolt carrier group, such as the front bolt 102 and the carrier 105, may be a metallic material, such as steel. In some embodiments, the front bolt 102 and the carrier 105 can move relative to one another and may be separable from one another (e.g., see gap G in FIG. 4B such that the components may translate in the forward/aft direction relative to one another). In other embodiments, the components of the bolt carrier group are not separable in the fore-aft direction (i.e., the parts analogous to the front bolt 102 and the carrier 105 cannot move relative to one another). In an installed configuration, at least one of the front bolt 102 and the carrier 105 includes one or more forward inserts 111, 112, 113, 114 and the carrier 105 includes one or more rear inserts 115. In some embodiments, the front bolt 102 includes a forward insert 111 on the left side (see FIG. 1A) and a forward insert 112 on the right side (see FIG. 1B). In certain embodiments, the carrier 105 includes a forward insert 113 on the left side (see FIG. 1A), a forward insert 114 on the right side (see FIG. 1B), and a rear insert 115. The rear insert 115 may extend through the opening 154 of the carrier 105 from the left side to the right side.

The one or more forward inserts 111, 112, 113, 114 (shown in FIGS. 1A-2B) may include at least one retaining feature 161 and an outer surface 168. The outer surface 168 may have a curved shape and, in some cases, may be cylindrical or partially cylindrical. The at least one retaining feature 161 may be a protrusion and may be designed to attach the insert to the relevant portion of the bolt carrier group. The outer surface 168 may be designed to interface with a portion of a firearm (e.g., such as the interior of an upper receiver, the inside of a buffer tube, or any other appropriate portion of a firearm). In some embodiments, the outer surface 168 is approximately parallel to adjacent portions of the outermost surface of the bolt carrier group. For example, the outer surface 168 of forward insert 111 may be approximately parallel to left side outer surface 102*a* of the front bolt 102 and/or the outer surface 168 of forward insert 113 may be approximately parallel to left side outer surface 105*a* of the carrier 105 (see FIG. 1A). Similarly, the outer surface 168 of forward insert 112 may be approximately parallel to right side outer surface 102*b* of the front bolt 102 and/or the outer surface 168 of forward insert 114 may be approximately parallel to right side outer surface 105*b* of the carrier 105 (see FIG. 1B). The outer surfaces 102*a*, 102*b*, 105*a*, 105*b* may be described as the outer metallic surfaces of the bolt carrier group. In some cases, the outer surfaces 168 may be at least flush with the outer metallic surfaces. In some embodiments, at least one of these outer surfaces 168 may be offset from or protrude beyond the respective surface of the front bolt 102 and/or the carrier 105.

Figure 2A:
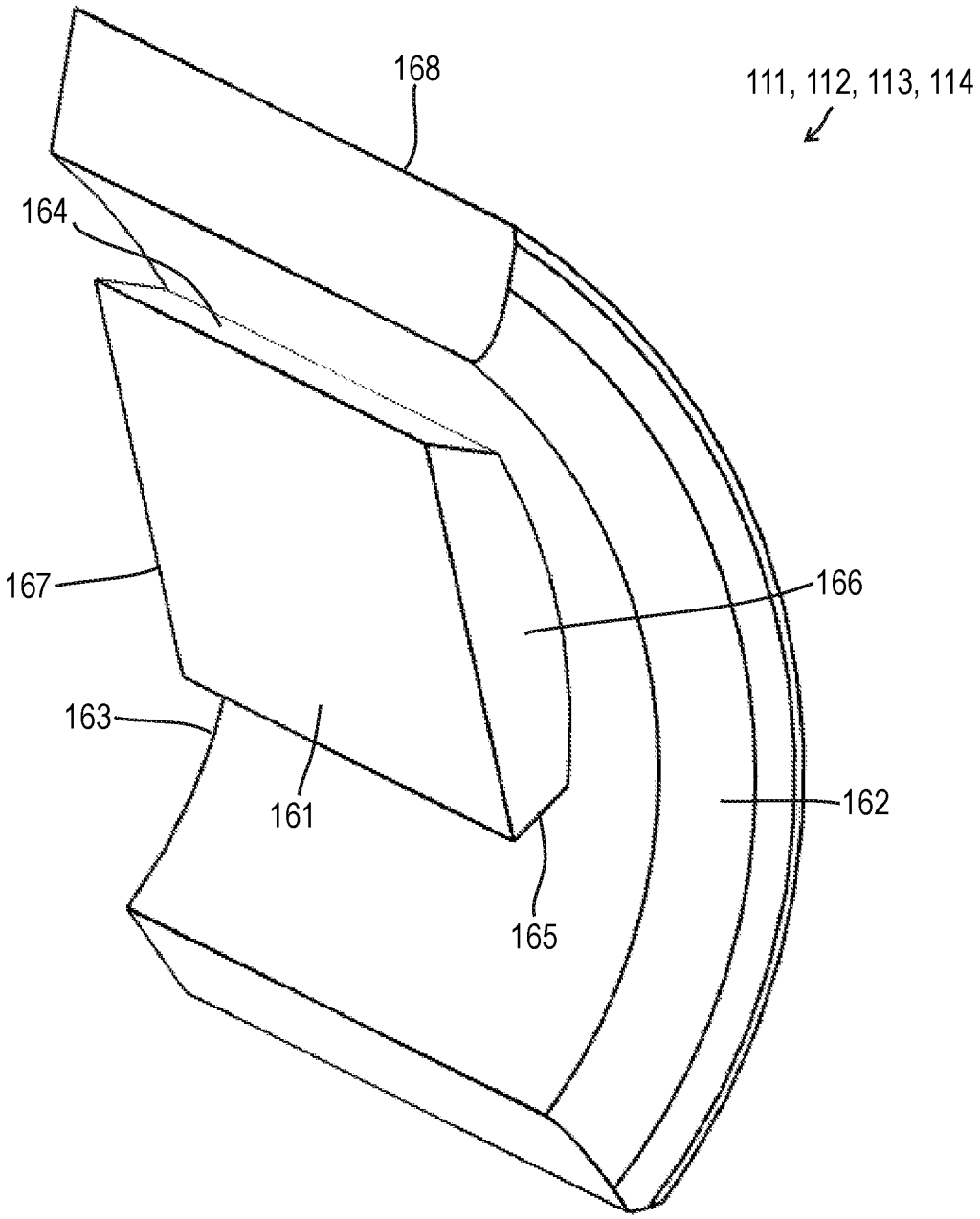
FIGS. 2A and 2B are perspective views of a forward insert for the bolt carrier group of FIG. 1A.
Figure 2B:
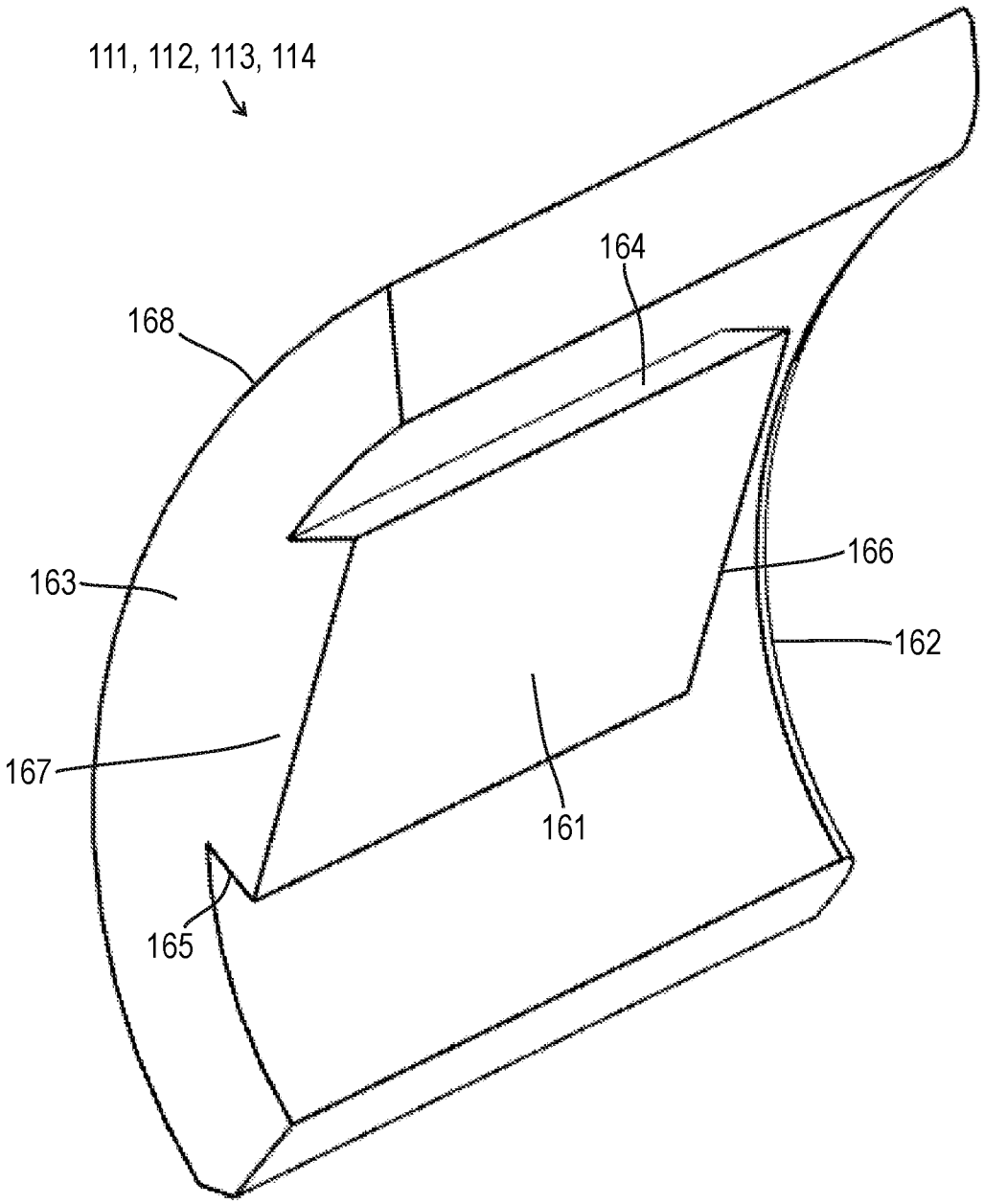
Figure 3:
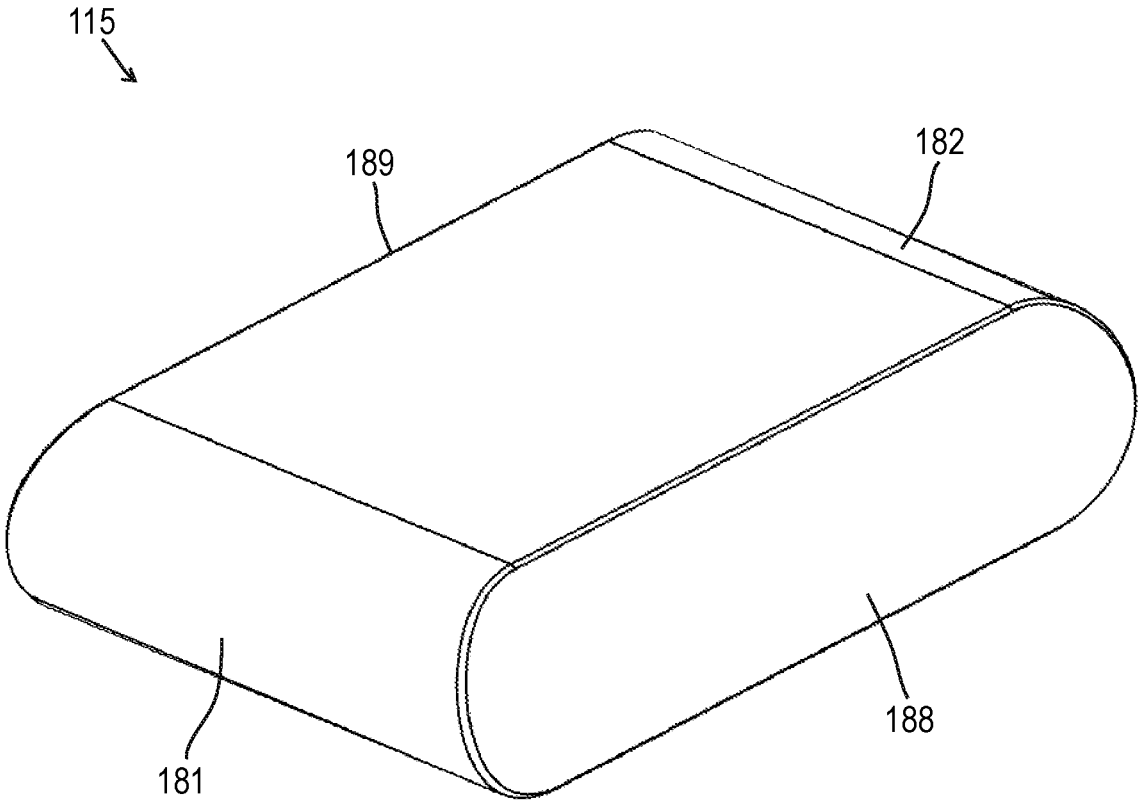
FIG. 3 is a perspective view of a rear insert for the bolt carrier group of FIG. 1A.
Figure 4A:
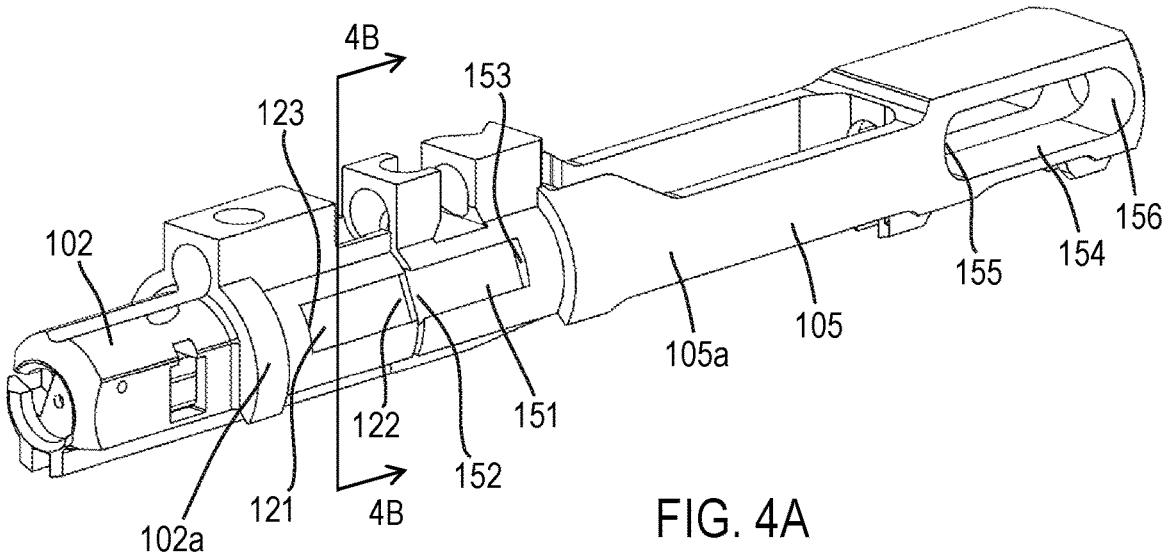
FIG. 4A is a perspective view of the bolt carrier group of FIG. 1A with the inserts removed.
Figure 4B:
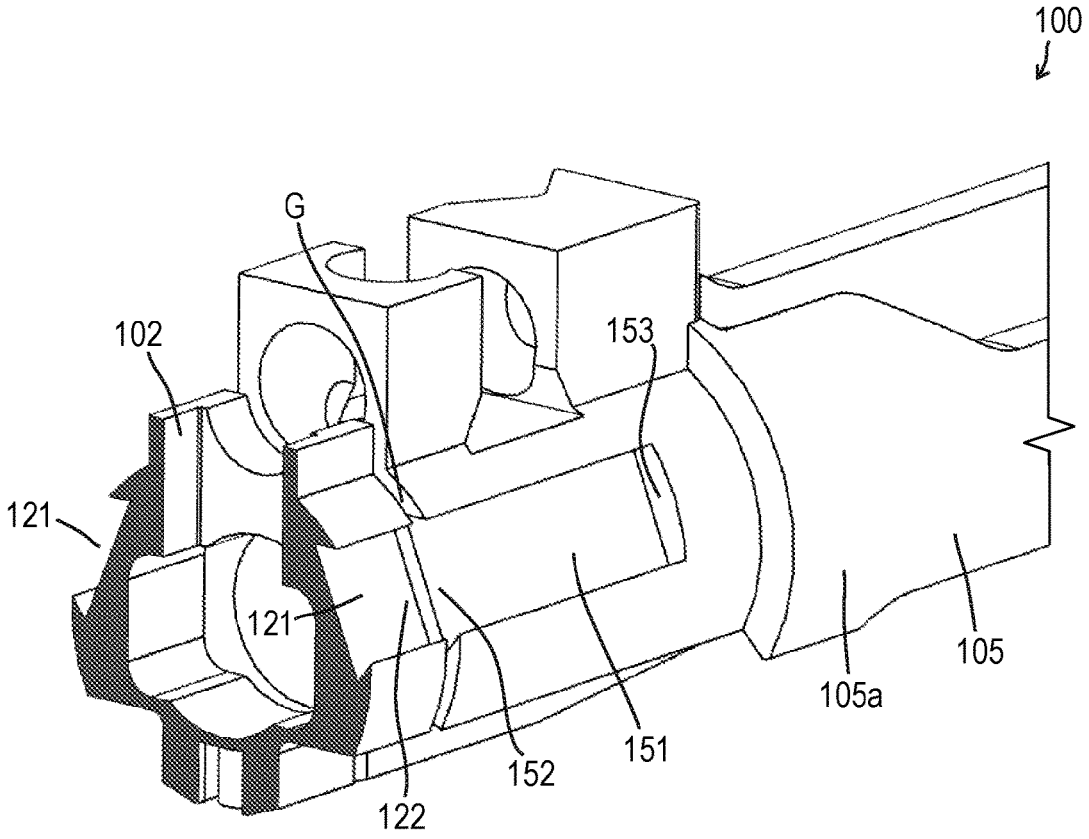
FIG. 4B is a cross-section view of the bolt carrier group of FIG. 4A.

As shown in FIGS. 2A and 2B, the at least one retaining feature 161 may be a mechanical attachment feature. The retaining feature 161 may include an angled upper surface 164 and/or an angled lower surface 165 that act as a dovetail attachment for engaging a corresponding cavity, such as cavity 121 of the front bolt 102 or cavity 151 of the carrier 105 (see FIGS. 4A and 4B). Because the front bolt 102 and the carrier 105 are separable from one another, the retaining feature 161 can slide into the open end of the cavity. For example, a first end 166 of the retaining feature 161 of forward insert 111 may slide into open end 122 of cavity 121 when the front bolt 102 is separate from the carrier 105. In such an arrangement, when the forward insert 111 is installed, the first end 166 of the retaining feature 161 would disposed adjacent to the closed end 123 of cavity 121 and the second end 167 of the retaining feature 161 would disposed adjacent to the open end 122 of cavity 121. In some embodiments, the first end 166 of the retaining feature 161 is offset from the first end 162 of the insert, and the second end 167 of the retaining feature 161 is aligned or flush with the second end 163 of the insert (see FIGS. 2A-2B). However, these components may be arranged in other ways (i.e., both ends flush, both ends offset, etc.). Similarly, a first end 166 of the retaining feature 161 of forward insert 113 may slide into open end 152 of cavity 151 when the carrier 105 is separate from the front bolt 102. In such an arrangement, when the forward insert 113 is installed, the first end 166 would be disposed adjacent to the closed end 153 of cavity 151 and the second end 167 would be disposed adjacent to the open end 152 of cavity 151.

Figure 5A:
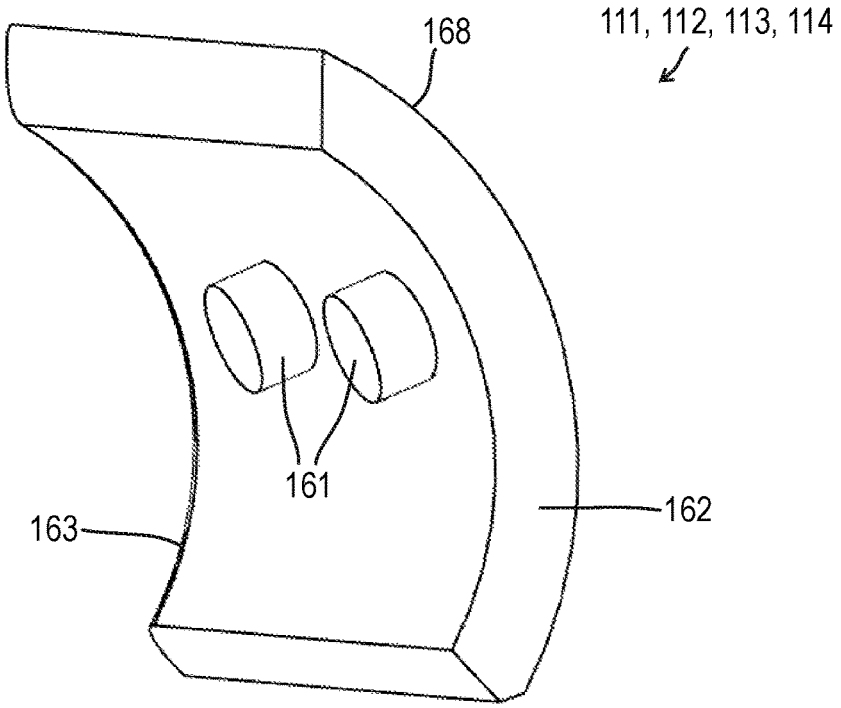
FIG. 5A is a perspective view of a forward insert for the bolt carrier group of FIG. 1A.
Figure 5B:
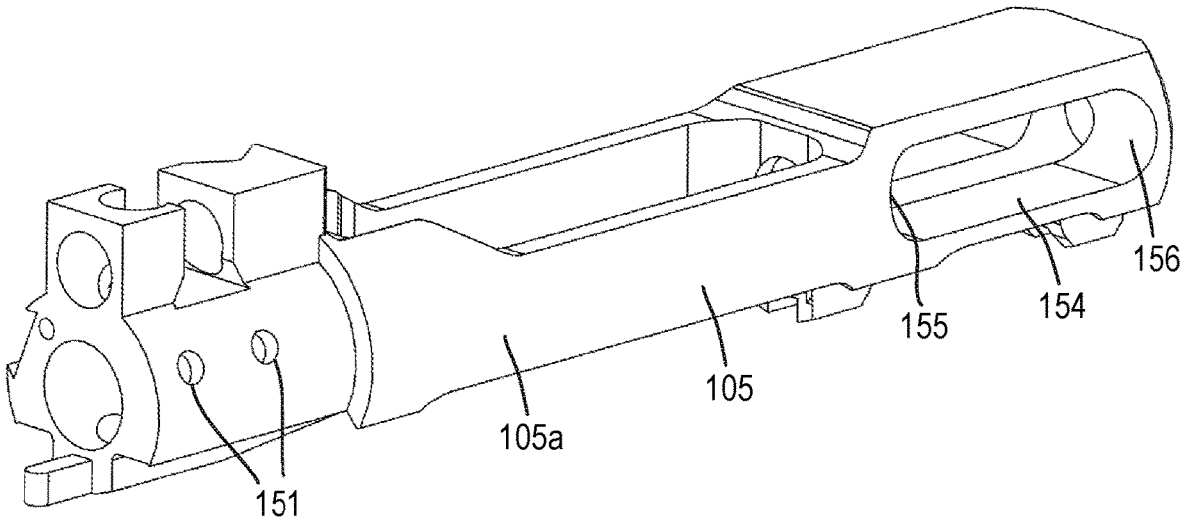
FIG. 5B is a perspective view of a carrier of the bolt carrier group of FIG. 1A with the inserts removed.

Although the drawings illustrate the retaining feature 161 of the forward inserts 111-114 as a dovetail attachment (as described above), the retaining feature 161 may be a different mechanical attachment structure, a chemical attachment (such as adhesive), or any other appropriate type of attachment between the forward inserts 111-114 and the bolt carrier group. In some embodiments, as shown in FIG. 5A, the retaining feature 161 may include one or more cylindrical protrusion(s) and the front bolt 102 and/or the carrier 105 may have holes that correspond to the cylindrical protrusion(s) such that the forward inserts 111-114 can be pressed into the corresponding portion of the bolt carrier group. As one example and as shown in FIG. 5B, the carrier 105 may have a cavity 151 that includes one or more blind hole(s). In other embodiments, the retaining feature 161 may include one or more conical protrusion(s) with an axial direction extending toward a center of the bolt carrier group and the components of the bolt carrier group (the front bolt 102 and the carrier 105) may have corresponding blind holes (as a cavity 121, 151) drilled toward the center of the bolt carrier group. Moreover, regardless of the shape of the retaining feature 161, the interface between the retaining feature 161 and the cavity 121, 151 may include a chemical attachment (such as adhesive) in combination with a mechanical attachment.

In other embodiments, the upper surface 164 and the lower surface 165 of the retaining feature 161 are curved convex surfaces such that (due to the flexibility of the retaining feature 161) the forward inserts 111-114 can be snapped into engagement with the corresponding portion of the bolt carrier group. The corresponding portions of the bolt carrier group may include cavities with concave surfaces that match the retaining feature 161. Such an arrangement would allow for the forward inserts 111-114 to be attached to the relevant portion of the bolt carrier group without sliding into an open end of a cavity (i.e., appropriate for a conventional AR-15 bolt carrier group that does not include gap G).

In other embodiments, one or more of the inserts 111-115 may be over molded in an appropriate position relative to the bolt carrier group. For example, in some embodiments, at least a portion of the bolt carrier group is inserted into a molding machine and held in position adjacent to a cavity. Material (such as polymer in a liquid form) is then injected into the cavity and cured to form the final shape of the insert. Such a process simplifies and reduces labor associated with securing the insert 111-115 onto the bolt carrier group. In addition, over molding the insert 111-115 allows for a more robust mechanical attachment between the insert and the bolt carrier group. In some embodiments, an over molded insert 111-115 may include a secure mechanical connection that cannot be disengaged without destroying the insert.

The one or more rear inserts 115 (shown in FIGS. 1A, 1B, and 3) may include at least one outer surface 188, 189. The outer surfaces 188, 189 may have a curved shape and, in some cases, may be cylindrical or partially cylindrical. The rear insert 115 may be designed to engage the opening 154 of the carrier 105 (see FIG. 4A) such that the outer surfaces 188, 189 are each designed to interface with a portion of a firearm (e.g., such as the interior of an upper receiver, the inside of a buffer tube, or any other appropriate portion of a firearm). The rear insert 115 may be designed to engage the opening 154 in an installed configuration where a forward portion 181 of the rear insert 115 would be disposed adjacent to forward end 155 of the opening 154 and a rear portion 182 of the rear insert 115 would be disposed adjacent to rear end 156 of the opening 154.

As shown in FIGS. 1A and 1B, the outer surfaces 188, 189 are approximately parallel to adjacent portions of the outermost surface of the bolt carrier group. For example, the outer surface 188 may be approximately parallel to left side outer surface 105*a* and/or the outer surface 189 may be approximately parallel to right side outer surface 105*b* of the carrier 105 (see FIGS. 1A and 1B). In some cases, at least one of these outer surfaces 188, 189 may be offset from or protrude beyond the respective surface of the carrier 105.

Figure 6A:
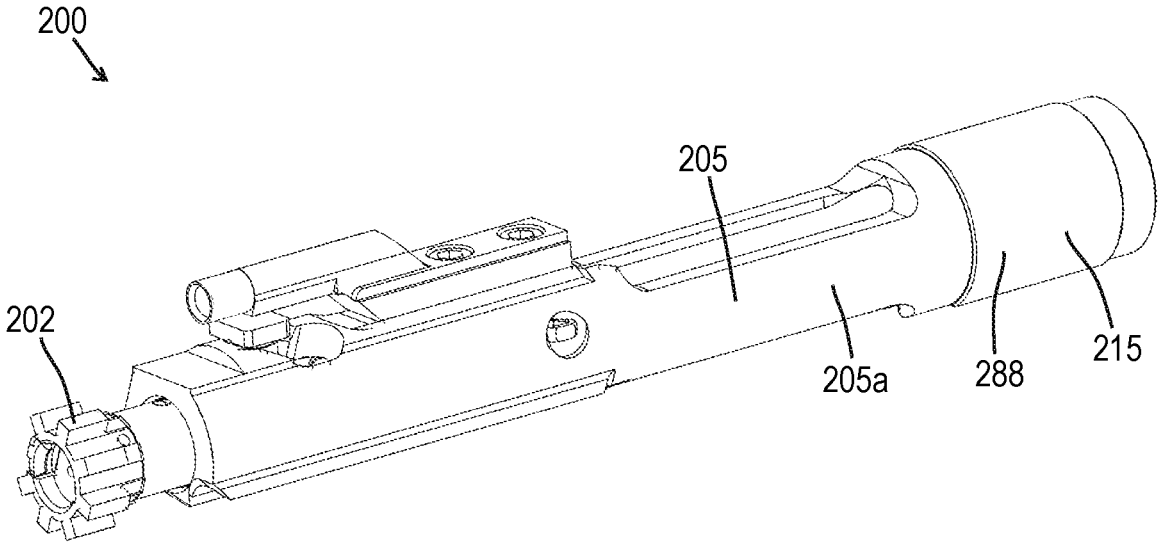
FIGS. 6A and 6B are perspective views of a bolt carrier group according to certain embodiments of the present invention.
Figure 6B:
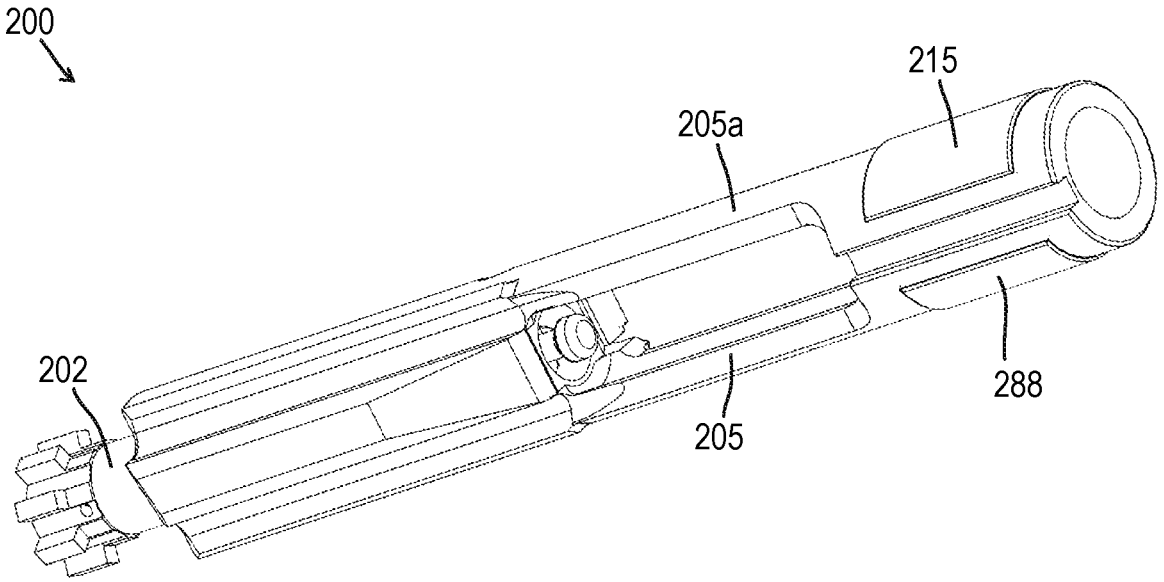
Figure 7:
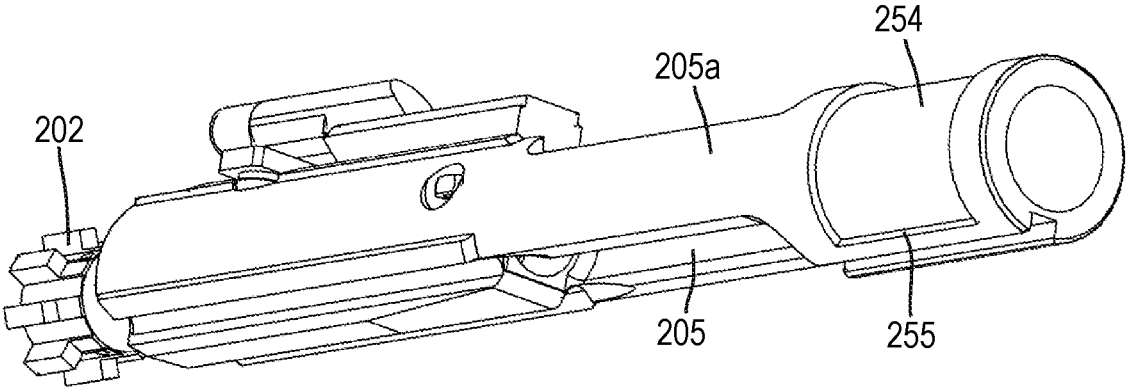
FIG. 7 is a perspective view of the bolt carrier group of FIG. 6A with the insert removed.
Figure 8:
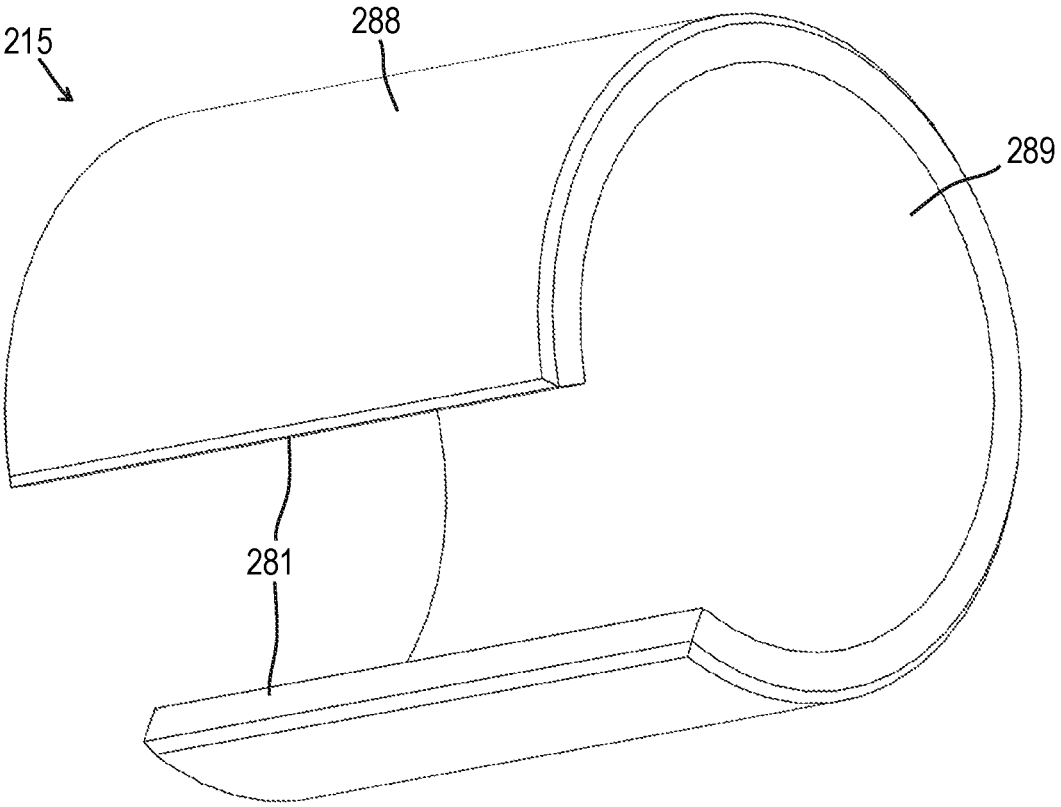
FIG. 8 is a perspective view of an insert for the bolt carrier group of FIG. 6A.

As shown in FIGS. 6A-8, in some embodiments, a bolt carrier group assembly 200 includes a bolt 202; a carrier 205 disposed rearward of the bolt 202; and one or more inserts 215. Although FIGS. 6A and 6B show only a single insert, the bolt carrier group assembly 200 may include other or additional inserts including, for example, inserts similar to the forward inserts 111-114 shown in FIGS. 1A-2B and 5A. The one or more inserts 215 (shown in FIGS. 6A, 6B, and 8) may include at least one outer surface 288. The outer surface 288 may have a curved shape and, in some cases, may be cylindrical or partially cylindrical. The insert 215 may be designed to engage a recess 254 of the carrier 205 (see FIGS. 7-8) such that the outer surface 288 is designed to interface with a portion of a firearm (e.g., such as the interior of an upper receiver, the inside of a buffer tube, or any other appropriate portion of a firearm). The insert 215 may be designed to engage the recess 254 in an installed configuration where the ends 281 of the insert 215 would each be disposed adjacent to the ends 255 of the recess 254. In the installed configuration, in some embodiments, the inner surface 289 of the insert 215 may be disposed adjacent to an outer surface of the recess 254.

In some embodiments, the outer surfaces 168, 188, 189, 288 of the inserts 111-115, 215 protrude beyond the respective surfaces of the bolt carrier group (102*a*, 102*b*, 105*a*, 105*b*, 205*a*) by approximately 0.005 in to 0.015 in (0.127 mm to 0.381 mm). In some cases, the outer surfaces 168, 188, 189, 288 of the inserts protrude beyond the respective surfaces of the bolt carrier group by approximately 0.007 in to 0.012 in (0.178 mm to 0.305 mm). In some embodiments, the outer surfaces 168, 188, 189, 288 of the inserts protrude beyond the respective surfaces of the bolt carrier group by approximately 0.010 in (0.254 mm). The outer surfaces 102*a*, 102*b*, 105*a*, 105*b*, 205*a* of the bolt carrier group may be machined to a smaller dimension than typical such that the outer surfaces 168, 188, 189, 288 of the inserts have an outer dimension typical for the specific bolt carrier group (i.e., the outer dimensions of outer surfaces 102*a*, 102*b*, 105*a*, 105*b*, 205*a* may be smaller than a conventional bolt carrier group by the offset described above).

The inserts 111-115, 215 may be constructed from a low friction material. The low friction material may be a metallic component with an external coating. For example, the inserts 111-115, 215 may be bronze, babbitt metal (including alloys with large amounts of tin, lead, copper, antimony, and/or arsenic), and/or other appropriate metallic materials. In some embodiments, the low friction material (and/or the external coating) is a polymer material including, for example, plastic, thermoplastic, nylon, polyoxymethylene (acetal), polytetrafluoroethylene, polyethylene, polypropylene, polyvinyl chloride, polystyrene, carbon composite, or other plastic or polymer materials. Due to material, the inserts 111-115 have a lower coefficient of friction compared to the metallic components of the bolt carrier group (including outer surfaces 102*a*, 102*b*, 105*a*, 105*b*). Accordingly, the bolt carrier group assembly 100 requires less force to move and is more efficient than a conventional bolt carrier group.

The components of any of the bolt carrier group assemblies 100, 200 described herein may be formed of materials including, but not limited to, thermoplastic, carbon composite, plastic, nylon, steel, aluminum, stainless steel, high strength aluminum alloy, other plastic or polymer materials, other metallic materials, other composite materials, or other similar materials. Moreover, the components may be attached to one another via suitable fasteners, which include, but are not limited to, screws, bolts, rivets, welds, over molding, injection molding, epoxy, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A bolt carrier group assembly for a firearm comprising:
a forward end;
a rear end;
at least one metallic bolt carrier group component comprising an outer metallic surface; and
at least two forward inserts that each comprises at least one retaining feature, an inner surface, and an outer surface, wherein:
the at least two forward inserts are disposed closer to the forward end compared to the rear end;
each retaining feature is smaller than at least one of a length or a width of the inner surface;
each outer surface is at least flush with or protrudes beyond the outer metallic surface; and
the at least two forward inserts comprise a lower coefficient of friction compared to the at least one metallic bolt carrier group component.

2. The bolt carrier group assembly of claim 1, wherein the at least two forward inserts comprise a polymer material.

3. The bolt carrier group assembly of claim 1, wherein each outer surface comprises a partially cylindrical shape.

4. The bolt carrier group assembly of claim 1, wherein each outer surface protrudes beyond the outer metallic surface.

5. The bolt carrier group assembly of claim 4, wherein each outer surface protrudes beyond the outer metallic surface by approximately 0.005 in to 0.015 in.

6. The bolt carrier group assembly of claim 1, wherein the at least two forward inserts comprise (i) at least one forward insert on a left hand side of the bolt carrier group assembly and (ii) at least one forward insert on a right hand side of the bolt carrier group assembly, wherein the at least one forward left side insert and the at least one forward right side insert are symmetric with one another.

7. The bolt carrier group assembly of claim 1, wherein each retaining feature secures the corresponding forward insert relative to the at least one metallic bolt carrier group component.

8. The bolt carrier group assembly of claim 1, wherein each retaining feature comprises an integral protrusion extending from the inner surface of the corresponding forward insert.

9. The bolt carrier group assembly of claim 1, wherein the at least one metallic bolt carrier group component comprises a cavity that corresponds to each retaining feature.

10. The bolt carrier group assembly of claim 1, wherein the at least one retaining feature comprises a cylindrical protrusion extending from the inner surface.

11. The bolt carrier group assembly of claim 1, further comprising a rear insert disposed closer to the rear end compared to the forward end.

12. The bolt carrier group assembly of claim 11, wherein the rear insert extends through an opening of the at least one metallic bolt carrier group component from a left hand side of the bolt carrier group assembly to a right hand side of the bolt carrier group assembly.

13. The bolt carrier group assembly of claim 11, wherein the rear insert comprises:

an outer surface that is at least partially cylindrical;

an inner surface; and an installed configuration, wherein, in the installed configuration, the inner surface is disposed adjacent to an outer surface of a corresponding recess of the at least one metallic bolt carrier group component.

14. The bolt carrier group assembly of claim 1, wherein the at least two forward inserts are over molded relative to the at least one metallic bolt carrier group component.

15. A bolt carrier group assembly for a firearm comprising:

at least one metallic bolt carrier group component comprising an outer metallic surface; and at least two inserts that each comprise a retaining feature, an inner surface, and an outer cylindrical surface, wherein:

each outer cylindrical surface is at least flush with or protrudes beyond the outer metallic surface, the at least two inserts are symmetrically arranged on the left and right sides of the at least one metallic bolt carrier group component;

each retaining feature extends from the inner surface of the corresponding insert; and the at least two inserts comprise a lower coefficient of friction compared to the at least one metallic bolt carrier group component.

16. The bolt carrier group assembly of claim 15, wherein the at least two inserts comprise a polymer material.

17. The bolt carrier group assembly of claim 15, wherein each outer cylindrical surface protrudes beyond the outer metallic surface.

18. The bolt carrier group assembly of claim 17, wherein each outer cylindrical surface protrudes beyond the outer metallic surface by approximately 0.005 in to 0.015 in.

19. The bolt carrier group assembly of claim 15, wherein:

each retaining feature is smaller than the inner surface and the outer cylindrical surface.

20. The bolt carrier group assembly of claim 15, further comprising a rear insert disposed closer to the rear end compared to the forward end.

21. The bolt carrier group assembly of claim 15, wherein each retaining feature secures the corresponding insert relative to the at least one metallic bolt carrier group component.

22. The bolt carrier group assembly of claim 15, wherein each retaining feature comprises an integral protrusion extending from the inner surface of the corresponding insert.

23. The bolt carrier group assembly of claim 15, wherein the at least two inserts comprise at least one selected from the group of thermoplastic, nylon, and polyoxymethylene.

24. The bolt carrier group assembly of claim 20, wherein the rear insert extends through an opening of the at least one metallic bolt carrier group component from a left hand side of the bolt carrier group assembly to a right hand side of the bolt carrier group assembly.

25. The bolt carrier group assembly of claim 15, wherein the at least one retaining feature comprises a cylindrical protrusion extending from the inner surface.

26. The bolt carrier group assembly of claim 15, wherein the at least two inserts are over molded relative to the at least one metallic bolt carrier group component.

* * * * *